US009267471B2

(12) United States Patent
Kato et al.

(10) Patent No.: US 9,267,471 B2
(45) Date of Patent: Feb. 23, 2016

(54) MOUNT STRUCTURE OF INTAKE AIR FLOW CONTROL VALVE DEVICE

(71) Applicants: Fuji Jukogyo Kabushiki Kaisha, Tokyo (JP); Toyota Boshoku Kabushiki Kaisha, Aichi (JP)

(72) Inventors: Junpei Kato, Tokyo (JP); Takeshi Nomura, Aichi (JP)

(73) Assignees: FUJI JUKOGYO KABUSHIKI KAISHA, Tokyo (JP); TOYOTA BOSHOKU KABUSHIKI KAISHA, Aichi (JP)

( * ) Notice: Subject to any disclaimer, the term of this patent is extended or adjusted under 35 U.S.C. 154(b) by 0 days.

(21) Appl. No.: 14/267,622

(22) Filed: May 1, 2014

(65) Prior Publication Data

US 2014/0352644 A1 Dec. 4, 2014

(30) Foreign Application Priority Data

May 29, 2013 (JP) ..... 2013-112589

(51) Int. Cl.
*F02M 35/10* (2006.01)
*F02M 35/116* (2006.01)

(52) U.S. Cl.
CPC ... *F02M 35/10255* (2013.01); *F02M 35/10085* (2013.01); *F02M 35/1165* (2013.01)

(58) Field of Classification Search
CPC ..... F02M 35/10144; F02M 35/10347; F02M 35/10085; F02M 35/10078; F02M 35/104
USPC ..... 123/184.21, 184.26, 184.53, 184.27, 123/184.58–184.61
See application file for complete search history.

(56) References Cited

U.S. PATENT DOCUMENTS

| | | | | |
|---|---|---|---|---|
| 5,875,758 | A * | 3/1999 | Fujita | F02B 27/02 123/184.61 |
| 8,443,782 | B2 * | 5/2013 | Ishihara | F02D 9/1035 123/184.21 |
| 2007/0144483 | A1 * | 6/2007 | Torii | F02D 9/103 123/337 |
| 2007/0216109 | A1 * | 9/2007 | Friedow | F01N 13/1827 277/593 |
| 2009/0050094 | A1 * | 2/2009 | Sano | F02B 31/06 123/184.21 |
| 2009/0050098 | A1 * | 2/2009 | Sano | F02B 31/06 123/184.61 |
| 2012/0000438 | A1 * | 1/2012 | Sakagami | F02B 27/0263 123/184.47 |

FOREIGN PATENT DOCUMENTS

JP 2007303327 A 11/2007

* cited by examiner

*Primary Examiner* — Lindsay Low
*Assistant Examiner* — Long T Tran
(74) *Attorney, Agent, or Firm* — Smith, Gambrell & Russell, LLP

(57) ABSTRACT

In an intake air flow control valve device a flange formed in a housing of the intake air flow control valve device is bolted to a cylinder head via a first gasket and a second gasket along opening outer peripheries of a first intake air passage and a second intake air passage, which are opened to a mount surface of the flange between the flange and a mount surface of the cylinder head.

17 Claims, 8 Drawing Sheets

MOUNT STRUCTURE OF INTAKE AIR FLOW CONTROL VALVE DEVICE

CROSS-REFERENCE TO RELATED APPLICATIONS

The present application claims priority from Japanese Patent Application No. 2013-112589 filed on May 29, 2013, the entire contents of which are hereby incorporated by reference.

BACKGROUND

1. Technical Field

The present invention relates to a mount structure of an intake air flow control valve device. In particular, the present invention relates to a mount structure for mounting, on a cylinder head, an intake air flow control valve device that is disposed in an intake manifold of an engine and controls an intake air flow formed in a combustion chamber.

2. Related Art

An intake air flow control valve device that is disposed in a resin intake manifold and controls an intake air flow formed in a combustion chamber is proposed, as disclosed in Japanese Unexamined Patent Application Publication (JP-A) No. 2007-303327, for example.

The intake air flow control valve device is applied to a four-cylinder engine, and includes a resin intake manifold 101 and valve units 104, as illustrated in an exploded perspective view of FIG. 7. In the intake manifold 101, four intake air passages 102 are formed by separation walls 101*a*, and each of the valve units 104 is disposed in each of the intake air passages 102.

The valve unit 104 includes a frame shaped housing 105, an intake air flow control valve 106, and a valve shaft 109. The plate shaped intake air flow control valve 106 has bosses protruding to bath sides, and each of the bosses is rotatably supported by a supporting hole of the housing 105 via a bearing. The valve shaft 109 penetrates a separation wall through-hole 101*b* of the intake manifold 101 and holes formed at the bosses of the intake air flow control valves 106. Thereby, the intake air passages 102 are opened and closed by synchronous rotation of the intake air flow control valves 106 in association with rotation of the valve shaft 109.

Further, in an intake air flow control valve device disposed in another intake manifold, a flange 114 is provided at an end of a housing 112 including intake air passages 113A and 113B, as illustrated in FIG. 8, which is a cross-sectional view of principal parts. The intake air passages 113A and 113B are adjacent to each other and communicated by a shaft penetrating unit 116 that has a shaft hole 116*a*.

A mount surface of the flange 114 formed at the end of the housing 112 is provided with annular gaskets 115*a* and 115*b* along respective opening outer peripheries of the intake air passages 113A and 113B.

A valve shaft 118 penetrates through the intake air passages 113A and 113B, and the shaft hole 116*a*. The distal end of the valve shaft 118 is rotatably supported, via a bush 119, by a supporting hole 112*a* formed at the outer end of the intake air passage 113B of the housing 112. The base end of the valve shaft 118 is coupled with an actuator 120, such as an electric motor, provided outside the intake air passage 113A of the housing 112. Plate shaped intake air flow control valves 117A and 117B, which are disposed in the intake air passages 113A and 113B, respectively, are provided on the valve shaft 118. Thereby, the intake air passages 113A and 113B are opened and closed by synchronous rotation of the intake air flow control valves 117A and 117B in association with rotation of the valve shaft 118 by the actuator 120.

In an intake air flow control valve device 111 thus configured, the flange 114 is bolted to a mount surface 151 of a cylinder block 150, where intake air ports 152*a* and 152*b* are opened via gaskets 115*a* and 115*b*.

According to JPA No. 2007-303327, the bosses, which is provided at the both sides of the respective intake air flow control valves 106, are rotatably supported by the housings 105 via bearings. However, the resin intake manifold and the housing 105 are not uniform in manufacturing shape and dimensional accuracy, and have low rigidity, compared with the conventional intake manifolds and housings made of metal, such as aluminum. Thus, deformation may be caused by environmental changes, such as increases and decreases in temperature by use. The deformation of the intake manifold and the housing 105 may hinder smooth operation due to deterioration in concentricity between the bosses of the intake air flow control valves 106 and the bearings.

In the intake air flow control valve device 111 illustrated in FIG. 8, deformation of the housing 112 caused by environmental changes, such as increases and decreases in temperature may also occur, since the resin intake manifold and the housing 112 are not uniform in manufacturing shape and dimensional accuracy, the resin housing 112 and the metal valve shaft 118 have different coefficients of thermal expansion respectively, the actuator 120 is disposed at the outer end at one intake air passage 113A side of the housing 112, and the bush 119 to pivotally support the distal end of the valve shaft 118 is disposed at the outer end at the other intake air passage 113B side of the housing 112. For example, as indicated by a virtual line 112*b*, the housing 112 may be deformed into a curved shape in a direction in which the end at the intake air passage 113B side, where the bush 119 is disposed, move away from the mount surface 151 of the cylinder head 150, with respect to the end at the intake air passage 113A side, where the actuator 120 is provided.

In this deformation, the displacement amount by which the bush 119 pivotally supporting the distal end of the valve shaft 118 moves away from the cylinder head 150 becomes large, and thus, the tilt of the shaft hole 116*a* of the shaft penetrating unit 116 may become larger than the tilt of the valve shaft 118. Accordingly, the concentricity between the valve shaft 118 and the shaft hole 116*a* is deteriorated, and thus, the valve shaft 118 and an inner peripheral surface of the shaft hole 116*a* come into contact with each other. As a result, operating performance may be possibly deteriorated.

If the shaft hole 116*a* having a large diameter is formed so as to avoid the contact between the valve shaft 118 and the shaft hole 116*a* of the shaft penetrating unit 116, a large gap is formed between the inner peripheral surface of the shaft hole 116*a* and the valve shaft 118. The intake air flowing through the intake air passage 113A and the intake air flowing through the intake air passage 113B are communicated and interfered with each other through the gap, thereby generating turbulence in the intake air passages 113A and 113B. As a result, deterioration in intake characteristic occurs since an intake air flow in a combustion chamber is not smoothly generated, and thus, combustion efficiency of the engine lowers, resulting in lowering output.

SUMMARY OF THE INVENTION

The present invention has been designed in consideration of the circumstances described above, and an object thereof is to provide a mount structure of an intake air flow control valve device that is capable of ensuring excellent operating performance and forming a suitable intake air flow in a combustion chamber.

A first aspect of the present invention provides a mount structure of an intake air flow control valve device that couples the intake air flow control valve device for controlling an intake air flow formed in a combustion chamber to a mount surface of a cylinder head via a gasket. The intake air flow control valve device includes: a resin housing; a valve shaft; and a first intake air flow control valve and a second intake air flow control valve. The resin housing includes a tubular housing main body having a first intake air passage and a second intake air passage, which continue to an intake manifold, and a shaft hole to communicate the first intake air passage with the second intake air passage by intersecting with the extending directions of the first intake air passage and the second intake air passage; and a flange integrally formed at the end of the housing main body, where the first intake air passage and the second intake air passage are opened to the mount surface. The valve shaft rotatably penetrates the shaft hole, the first intake air passage, and the second intake air passage. The valve shaft has an distal end rotatably held at one end side of the housing main body and a base end coupled with an actuator disposed at the other end side of the housing main body. The first intake air flow control valve and the second intake air flow control valve are provided on the valve shaft and disposed in the first intake air passage and in the second intake air passage, respectively. The flange is bolted to the cylinder head via an annular first gasket along an opening outer periphery of the first intake air passage opened to the mount surface of the flange and via an annular second gasket along an opening outer periphery of the second intake air passage opened to the mount surface of the flange between the flange and the mount surface of the cylinder head. The deformation of the housing is suppressed by compression reaction threes of the first gasket and the second gasket.

The flange may be bolted to the cylinder head via the annular first gasket along the opening outer periphery of the first intake air passage opened to the mount surface of the flange and via the annular second gasket having the compression reaction force smaller than the compression reaction force of the first gasket along the opening outer periphery of the second intake air passage opened to the mount surface of the flange.

The first gasket and the second gasket may be a continuous annular shape with a rectangular cross section, and, in a no-load state, the axial height of the first gasket may be higher than the axial height of the second gasket.

The first gasket may be a continuous annular shape with a rectangular cross section, having an inner peripheral surface and an outer peripheral surface, and the second gasket may be a continuous annular shape with a polygonal cross section, having an axial base end surface and an axial distal end surface that protrude so as to form ridge lines, and an inner peripheral surface and an outer peripheral surface.

The first gasket may have the same shape as the second gasket, and the hardness of the first gasket may be higher than the hardness of the second gasket.

DETAILED DESCRIPTION

Figure 1:
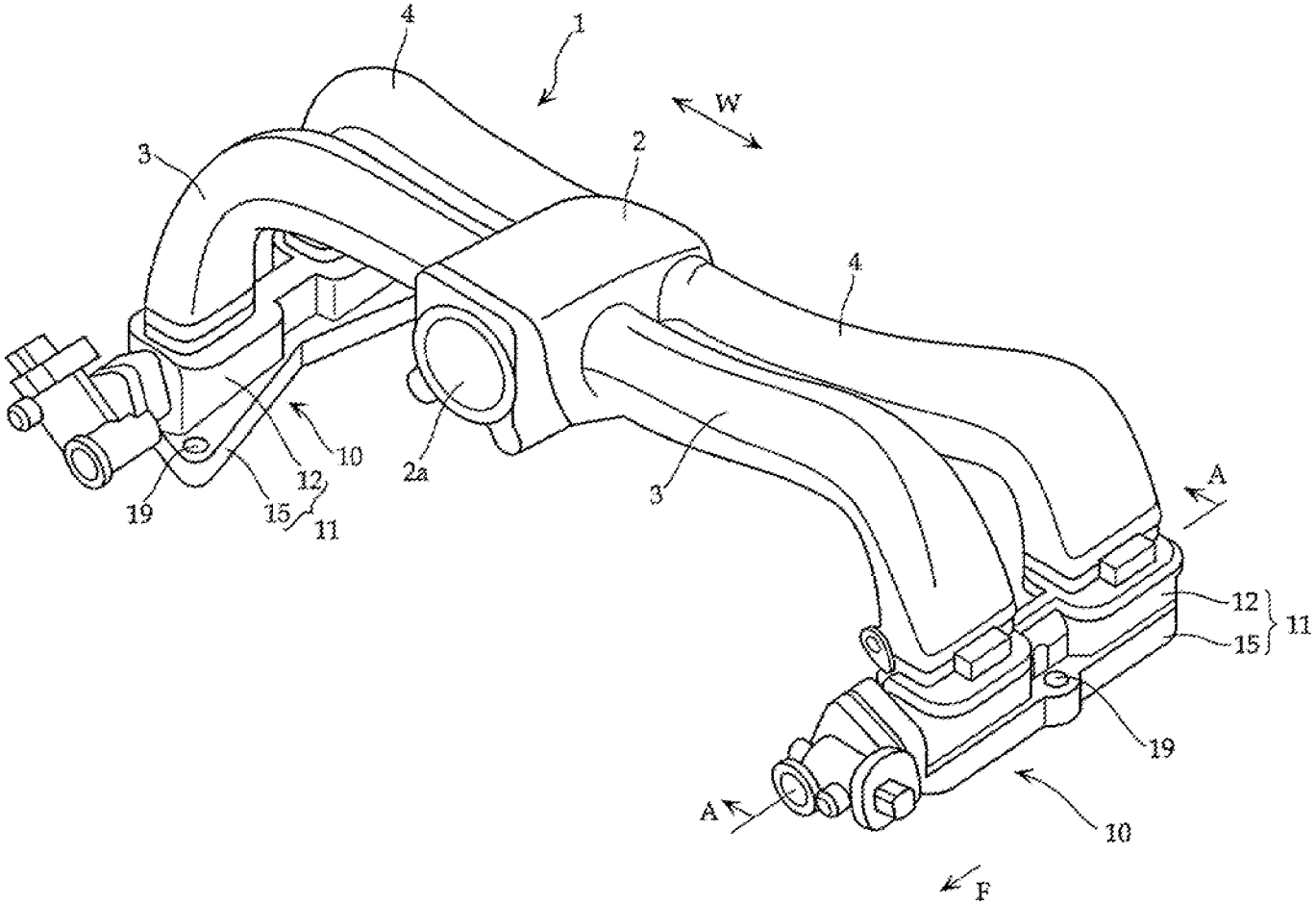
FIG. 1 is a perspective view illustrating an intake manifold including an intake air flow control valve device according to an implementation.
Figure 2:
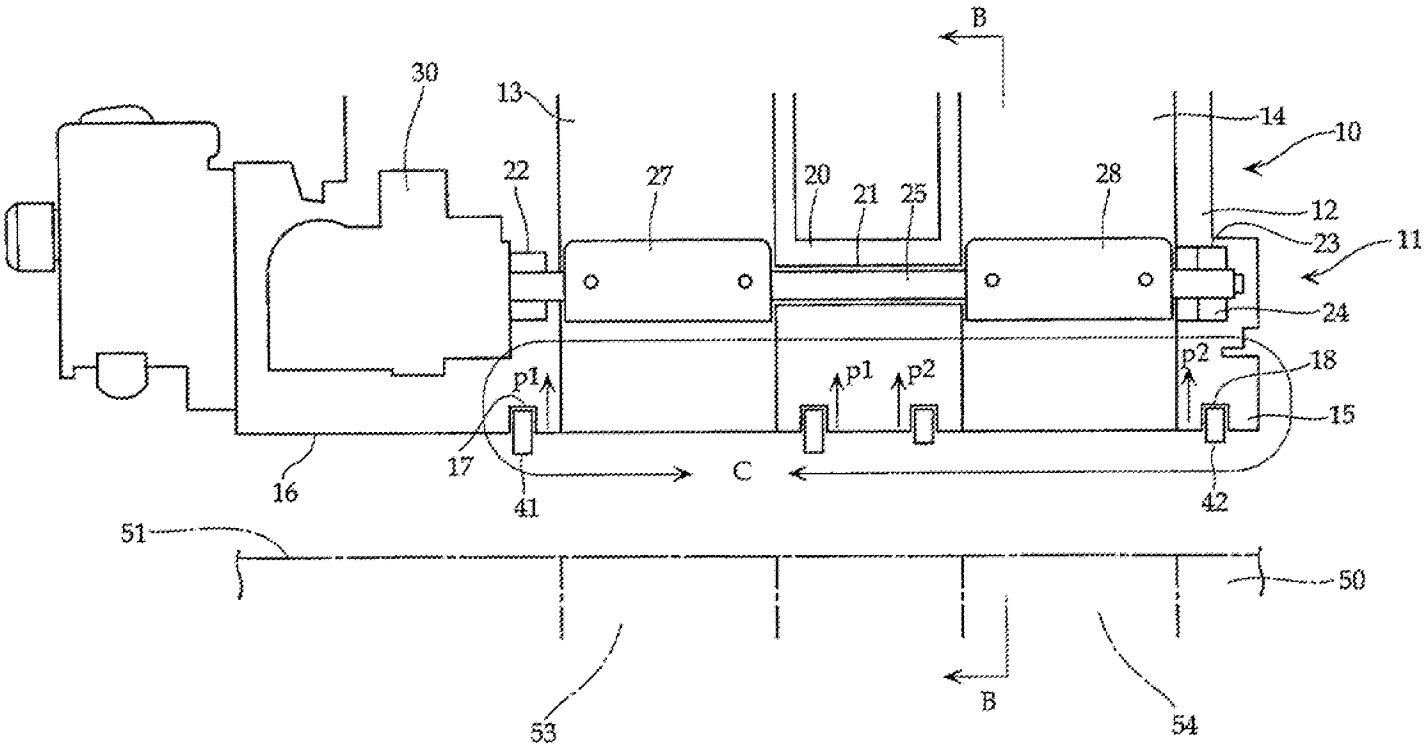
FIG. 2 is a cross-sectional view taken along a line A-A in FIG. 1.
Figure 3:
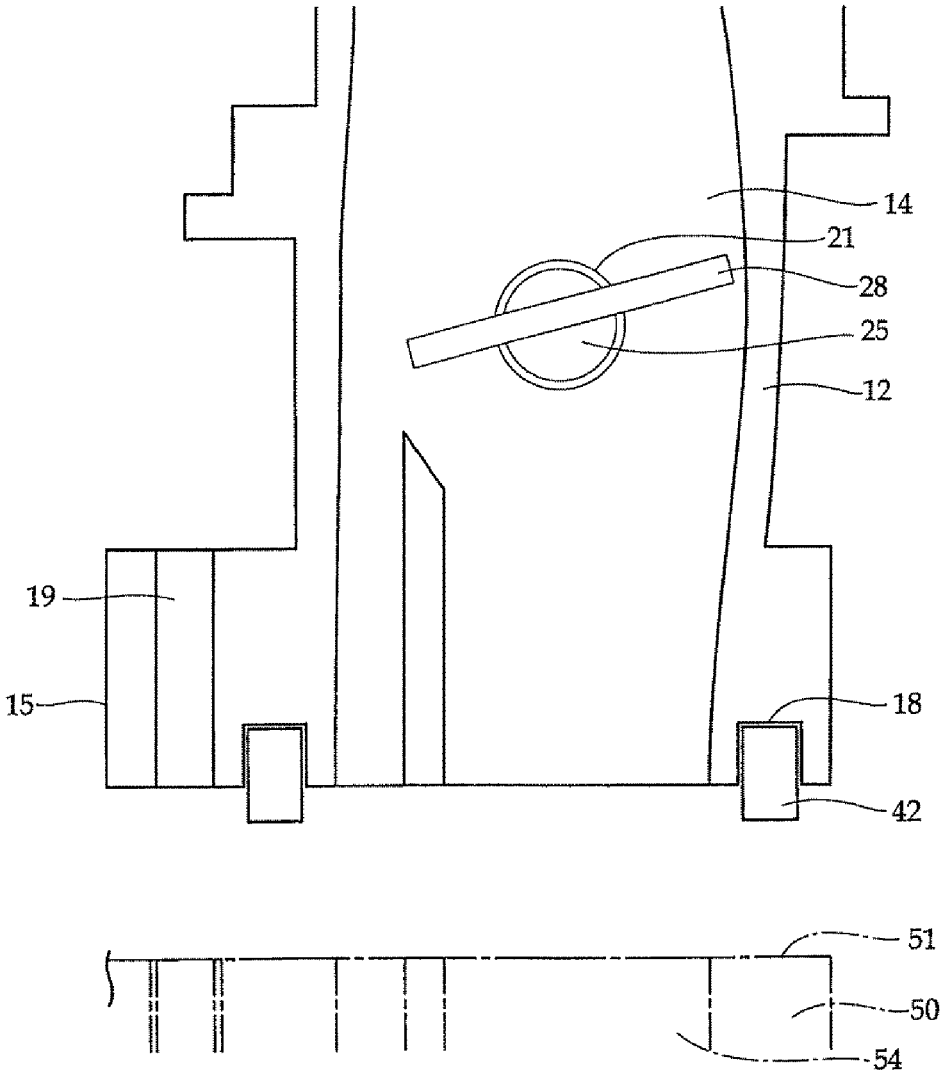
FIG. 3 is a cross-sectional view taken along a line B-B in FIG. 2.

Hereinafter, an implementation of the present invention will be described with reference to the drawings. FIG. 1 is a perspective view illustrating an intake manifold including an intake air flow control valve device, FIG. 2 is a cross-sectional view that is taken along a line A-A in FIG. 1 and illustrates an overview of the intake air flow control valve device, and FIG. 3 is a cross-sectional view taken along a line BB in FIG. 2. In the description of the implementation, a direction of an arrow W in FIG. 1 is the left-right direction of the intake manifold, and a direction of an arrow F in FIG. 1 is the front direction of the intake manifold.

The intake manifold including the intake air flow control valve device according to the implementation is attached to a horizontally opposed four-cylinder engine. As illustrated in FIG. 1, an intake manifold 1 is formed of synthetic resin having excellent thermal resistance, such as polyamide resin, and includes a surge tank 2 and a pair of a front intake air pipe 3 and a rear intake air pipe 4, which are connected with both right and left sides of the surge tank 2, respectively.

An opening 2*a* for air intake is formed in the front surface of the surge tank 2. An air duct for sending intake air filtered by an air cleaner is connected with the opening 2*a*. The front intake air pipe 3 and the rear intake air pipe 4 are disposed in a right-left symmetrical manner while branching in the front-rear direction so as to communicate with intake air ports 53 and 54, which are opened in mount surfaces 51 of cylinder heads 50 at both sides of the horizontally opposed engine.

An intake air flow control valve device 10 to control an intake air flow formed in a combustion chamber is provided at the right and left distal ends of the front intake air pipe 3 and the rear intake air pipe 4.

As illustrated in FIG. 2 and FIG. 3, the intake air flow control valve device 10 includes a housing 11 which has a tubular housing main body 12 and a flange 15. The tubular housing main body 12 is integrally formed with the front intake air pipe 3 and the rear intake air pipe 4 of the intake manifold 1 and includes a first intake air passage 13 and a second intake air passage 14 which continue to the front intake air pipe 3 and the rear intake air pipe 4. The flange 15 is integrally formed at the end of the housing main body 12 and includes a flat mount surface 16 where the first intake air passage 13 and the second intake air passage 14 are opened.

On the mount surface 16 of the flange 15, a first gasket mounting groove 17 and a second gasket mounting groove 18 are formed along opening outer peripheries of the first intake air passage 13 and the second intake air passage 14. Further, a mounting bolt hole 19 is drilled in the flange 15. The first gasket mounting groove 17 and the second gasket mounting groove 18, which are formed on the flange 15, and a first gasket 41 and a second gasket 42 to be attached on the first gasket mounting groove 17 and the second gasket mounting groove 18 are described in detail below.

In the housing main body 12, a shaft penetrating unit 20 is formed which extends in a direction intersecting with extension directions of the first intake air passage 13 and the second intake air passage 14, between the first intake air passage 13 and the second intake air passage 14 and has a shaft hole 21 communicating the first intake air passage 13 with the second intake air passage 14. A through-hole 22 is formed at the front part of the housing main body 12 in opposed coaxial relation to the shaft hole 21 while the first intake air passage 13 is interposed between the through-hole 22 and the shaft hole 21, and a supporting hole 23 is formed at the rear part of the housing main body 12 in opposed coaxial relation to the shaft hole 21 while the second intake air passage 14 is interposed between the shaft hole 21 and the supporting hole 21. A metal bush 24 is held by the supporting hole 23. That is, the bush 24 is disposed at the rear part of the housing main body 12, which is one end thereof.

A metal valve shaft 25 is formed in a straight shaft, has ensured strength, and penetrates the through-hole 22, the first intake air passage 13, the shaft hole 21 of the shaft penetrating unit 20, and the second intake air passage 14. Further, the distal end of the valve shaft 25 is rotatably supported by the supporting hole 23 via the bush The base end of the valve shaft 25 is coupled with the front part, which is the other end of the housing main body 12 at the first intake air passage 13 side and with an actuator 30, such as an electric motor, provided in the flange 15. A plate shaped first intake air flow control valve 27 which is disposed in the first intake air passage 13 to open and close the first intake air passage 13 and a plate shaped second intake air flow control valve 28 which is disposed in the second intake air passage 14 to open and close the second intake air passage 14 are provided on the valve shaft 25.

If the intake air flow control valve device 10 with such configuration is mounted to the cylinder head 50 by a mounting bolt to be inserted into the mounting bolt hole 19, via an ordinary head gasket between the mount surface 16 of the flange 15 and the mount surface 51 of the cylinder head 50, deformation may be caused due to repeated environmental changes by use, such as increases and decreases in temperature, since the resin intake manifold 1 and the housing 11 are not uniform in manufacturing shape and dimensional accuracy, the actuator 30 is disposed at the front part side of the first intake air passage 13 in a biased manner and, via the bush 24, the distal end of the metal valve shaft 25 having a different coefficient of thermal expansion from that of the resin housing 11 is disposed at the rear side of the second intake air passage 14 of the housing 11. For example, the second intake air passage 14 side, where the bush 24 is disposed, tends to twist or deform into a curved shape so as to separate from the cylinder head 50, with respect to the front part side, where the actuator 30 is provided. Due to this deformation, the tilt of the shaft hole 21 of the shaft penetrating unit 20 may become larger than the tilt of the valve shaft 25. In this case, the concentricity between the valve shaft 25 and the shaft hole 21 is deteriorated, and thus, the valve shaft 25 and an inner peripheral surface of the shaft hole 21 come into contact with each other. As a result, operating performance may be deteriorated.

Figure 4:
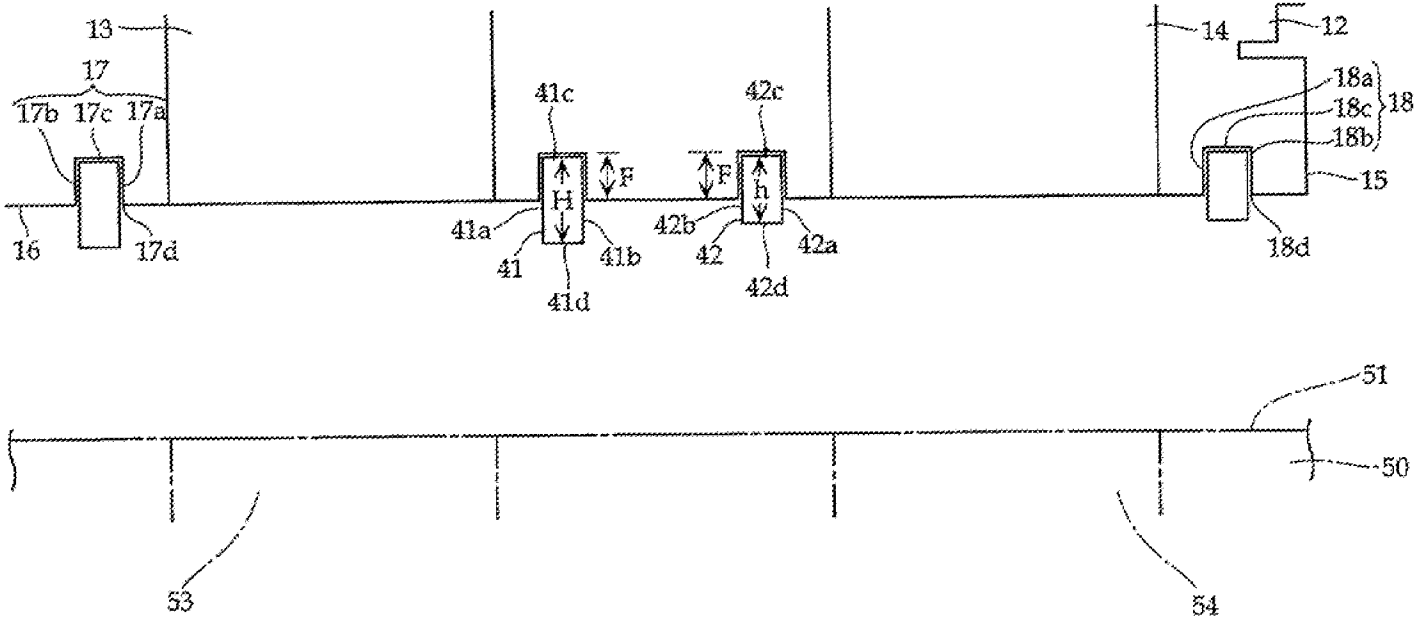
FIG. 4 is an enlarged view of a part C in FIG. 2.

In the implementation, as illustrated in FIG. 4, the first gasket mounting groove 17 formed on the mount surface 16 of the flange 15 is formed in a continuous annular shape with a rectangular cross section having an opening 17*d* on the mount surface 16. The opening 17*d* has: an annular inner surface 17*a*; an annular outer surface 17*b*, which are opposed to the mount surface 51 orthogonally intersecting the annular inner surface 17*a* and the annular outer surface 17*b* along the opening outer periphery of the first intake air passage 13 such that a direction perpendicular to the mount surface 16 is a groove depth F; and a flat bottom surface 17*c* opposing to the mount surface 51 of the cylinder head 50.

Similarly to the first gasket mounting groove 17, the second gasket mounting groove 18 is formed in a continuous annular shape with a rectangular cross section having an opening 18*d* on the mount surface 16. The opening 18*d* has: an annular inner surface 18*a*; an annular outer surface 18*b*, which are opposed to the mount surface 51 orthogonally intersecting the annular inner surface 18*a* and the annular outer surface 18*b* along the opening outer periphery of the second intake air passage 14 such that a direction perpendicular to the mount surface 16 is the groove depth F; and a flat bottom surface 18*c*.

The first gasket 41 to be attached on the first gasket mounting groove 17 is a molded body made of rubber, for example, and is formed into an annular shape to fit the first gasket mounting groove 17. The first gasket 41 has a cross section shape having a height H higher than the depth F of the first gasket mounting groove 17, and is formed into an annular shape with a rectangular cross section having: an inner surface 41*a*; an outer surface 41*b*, which are opposed to the inner surface 17*a* and the outer surface 17*b* of the first gasket mounting groove 17; a base end surface 41*c*; and a distal end surface 41*d*. As illustrated in FIG. 4, when fitted into the first gasket mounting groove 17 such that the base end surface 41*c* abuts on the bottom surface 17*c* of the first gasket mounting groove 17, a region including the distal end surface 41*d* protrudes from the opening 17*d* of the first gasket mounting groove 17, by the difference between the depth F of the first gasket mounting groove 17 and the height H of the first gasket 41.

The second gasket 42 to be attached on the second gasket mounting groove 18 is a molded body made of a material similar to that of the first gasket 41, and is formed into an annular shape to fit the second gasket mounting groove 18. The second gasket 42 has a cross section shape having a height h higher than the depth F of the second gasket mounting groove 18 and lower than the height H of the first gasket 41 and a width similar to that of the first gasket 41, and is formed into an annular shape with a rectangular cross section having: an inner surface 42*a*; an outer surface 42*b*, which are opposed to the inner surface 18*a* and the outer surface 18*b* of the second gasket mounting groove 18; a base end surface 42*c*; and a distal end surface 42*d*. As illustrated in FIG. 4, when fitted into the second gasket mounting groove 18 such that the base end surface 42*c* abuts on the bottom surface 18*c* of the second gasket mounting groove 18, a region including the distal end surface 42*d* protrudes from the opening 18*d* of the second gasket mounting groove 18, by the difference between the depth F of the second gasket mounting groove 18 and the height h of the second gasket 42.

In a no-load state in which the first gasket 41 and the second gasket 42 are attached to the first gasket mounting groove 17 and second gasket mounting groove 18, respectively, the height of the protrusion of the first gasket 41 protruding from the mount surface 16 is set to be higher than the height of the protrusion of the second gasket 42.

When the height H of the first gasket 41 is set so as to be higher than the height h of the second gasket 42 as described above, an axial compressive deformation amount of the first gasket 41 is larger than a compressive deformation amount of the second gasket 42, when the first gasket 41 and the second gasket 42 are axially compressed such that the protruding part of the first gasket 41 and the second gasket 42 are equal in height from the mount surface 16. Thus, compression reaction force of the first gasket 41 is set to be larger than compression reaction force of the second gasket 42.

The flange 15 of the intake air flow control valve device 10 is fastened to the mount surface 51 of the cylinder head 50 by the mounting bolt, which is inserted into the mounting bolt hole 19, in a state in which the first gasket 41 and the second gasket 42 are attached to the first gasket mounting groove 17 and second gasket mounting groove 18, respectively. By the fastening, the first gasket 41 is compressed between the bottom surface 17*c* of the first gasket mounting groove 17 and the mount surface 51 of the cylinder head 50, and the second gasket 42 is compressed between the bottom surface 18*c* of the second gasket mounting groove 18 and the mount surface 16 of the cylinder head 50. As a result, the first gasket 41 and the second gasket 42 are compressively deformed to be equal in height.

In the flange 15, a relatively large compression reaction force of the first gasket 41 is applied along the first gasket mounting groove 17, and a relatively small compression reaction force of the second gasket 42 is applied along the second gasket mounting groove 18, in association with the compressive deformation of the first gasket 41 and the second gasket 42.

FIG. 2 illustrates the compression reaction forces of the first gasket 41 and the second gasket 42: a relatively small compression reaction force p2 of the second gasket 42 is mainly applied to the rear end of the housing 11, where the bush 24 to pivotally support the distal end of the valve shaft 25 is arranged, as illustrated in. The relatively small compression reaction force p2 of the second gasket 42 and a relatively large compression reaction force p1 of the first gasket 41 are applied to the region between the first intake air passage 13 and the second intake air passage 14, where the shaft hole 21, through which the central part in the longitudinal direction of the valve shaft 25 is penetrated, is formed (the compression reaction force p2+the compression reaction force p1). Further, the compression reaction force p1 of the first gasket 41 is mainly applied to the front end of the housing 11, where the actuator 30 is provided.

While the compression reaction three p2 of the second gasket 42 and the compression reaction three p1 of the first gasket 41 are applied to the rear end of the housing 11, in which the bush 24 to support the distal end of the valve shaft 25 is disposed, and the front end, both of the compression reaction force p1 of the first gasket 41 and the compression reaction force p2 of the second gasket 42 are applied to the central part of the housing 11 in the front-rear direction, where the shaft penetrating unit 20 is formed.

As a result, deformation of the housing 11, which may occur due to environmental changes, is suppressed, and displacement between the shaft hole 21 of the shaft penetrating unit 20 and the valve shaft 25 is suppressed. Thus, it is possible to maintain the concentricity between the shaft hole 21 and the valve shaft 25, thereby effectively avoiding contact between the inner peripheral surface of the shaft hole 21 and the valve shaft 25 without increasing the diameter of the shaft hole 21.

As a result, it is possible to prevent the increase in the diameter of the shaft hole 21 of the shaft penetrating unit 20, and thus, it is possible to reduce a gap between the shaft hole 21 and the valve shaft 25. Accordingly, the intake air flowing through the first intake air passage 13 and the intake air flowing through the second intake air passage 14 are prevented from communicating and interfering with each other, thereby suppressing generation of turbulence in the first intake air passage 13 and the second intake air passage 14. As a result, an intake air flow in a combustion chamber is smoothly controlled, and thus, it is possible to ensure excellent operating performance, for example, improved combustion efficiency of the engine by improvement in intake characteristic, and to form a suitable intake air flow in a combustion chamber.

In the above-described implementation, the compressive deformation amount of the second gasket 42 is made larger than the compressive deformation amount of the first gasket 41, by using the first gasket 41 and the second gasket 42, which have different heights, whereby the compression reaction force of the first gasket 41 is set to be larger than the compression reaction force of the second gasket 42. Alternatively, it is possible to set different compression reaction force by making the cross section shape different between the first gasket and the second gasket.

An example of cases where the cross section shape is different between the gaskets will be described with reference to the FIG. 5.

Figure 5:
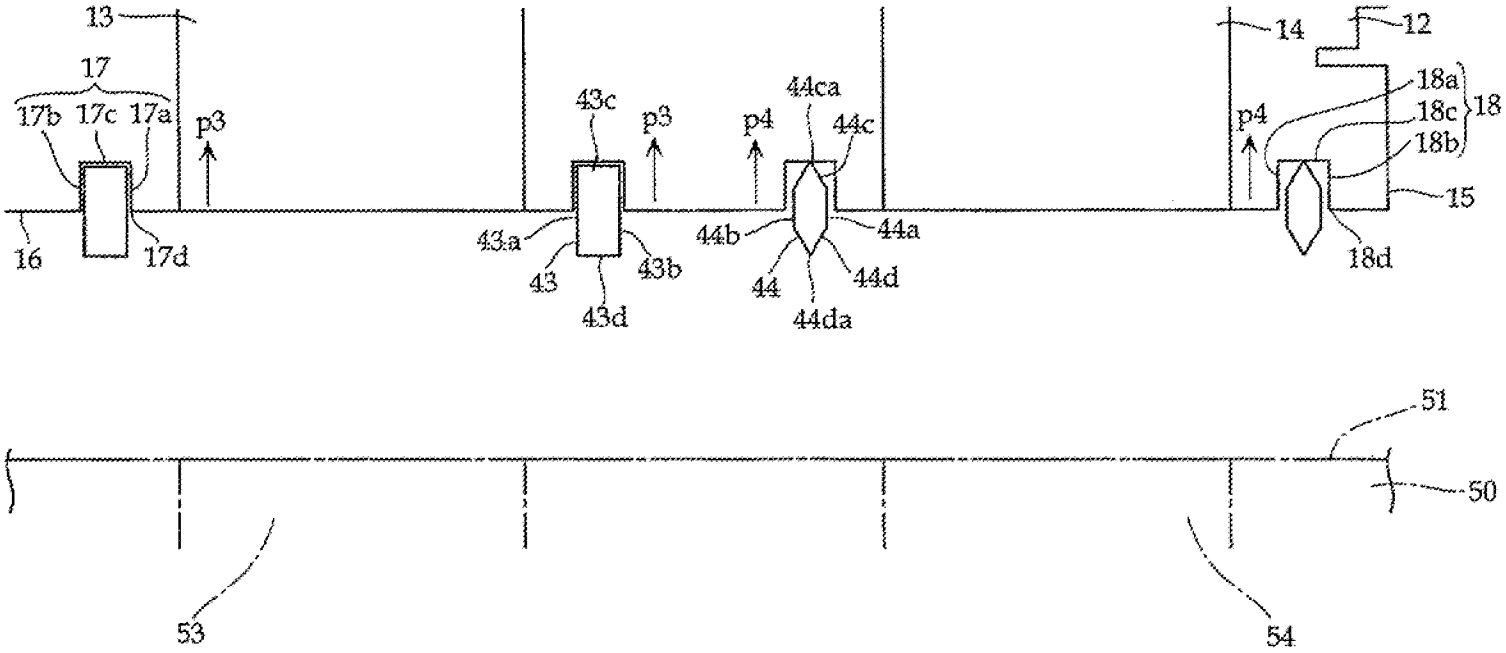
FIG. 5 is a cross-sectional view of principal parts illustrating another example of a gasket.

FIG. 5 is a cross-sectional view corresponding to FIG. 4. The first gasket mounting groove 17 and the second gasket mounting groove 18, which are formed on the mount surface 16 of the flange 15, have the same shape as the first gasket mounting groove 17 and second gasket mounting groove 18, which are illustrated in FIG. 4 described above. Thus, the same reference numerals are allocated to the corresponding parts and description thereof is omitted.

A first gasket 43 to be attached on the first gasket mounting groove 17 is a molded body made of rubber, or the like, and is formed into an annular shape to fit the first gasket mounting groove 17. The first gasket 43 has a cross section shape having a height higher than the depth of the first gasket mounting groove 17, and is formed into an annular shape with a rectangular cross section having: an inner surface 43*a*; an outer surface 43*b*, which are opposed to the inner surface 17*a* and the outer surface 17*b* of the first gasket mounting groove 17; a base end surface 43*c*; and a distal end surface 43*d*.

A second gasket 44 to be attached on the second gasket mounting groove 18 is a molded body made of a material similar to that of the first gasket 43. The cross section of the second gasket 44 has a hexagonal shape having an inner surface 44*a* and an outer surface 44*b*, which are opposed to the inner surface 18*a* and the outer surface 18*b* of the second gasket mounting groove 18, a base end surface 44*c* having a widthwise central part protruding as if to form a ridge line, and a distal end surface 44*d* having a widthwise central part protruding as if to form a ridge line, and is formed such that the height from an apex 44*ca* of the base end surface 44*e* to an apex 44*da* of the distal end surface 44*d* is equal to the height of the first gasket 43.

As described above, while the first gasket 43 has the rectangular cross section shape, the cross section shape of the second gasket 44 is in the hexagonal shape in which the apex 44*ca* of the base end surface 44*c* and the apex 44*da* of the distal end surface 44*d* protrude as if to form ridge lines, whereby, the compression reaction force of the second gasket 44 becomes smaller than the compression reaction force of the first gasket 43, and the compression reaction force of the first gasket 43 becomes larger than the compression reaction force of the second gasket 44.

The intake air flow control valve device 10 is fastened to the cylinder head 50 by the mounting bolt in a state in which the first gasket 43 and the second gasket 44 are attached to the first gasket mounting groove 17 and second gasket mounting groove 18, respectively. By the fastening, the first gasket 43 is compressed between the bottom surface 17*c* of the first gasket mounting groove 17 and the cylinder head 50, and the second gasket 44 is compressed between the bottom surface 18*c* of the second gasket mounting groove 18 and the mount surface 51 of the cylinder head 50.

FIG. 5 illustrates the compression reaction force of the first gasket 43 and the second gasket 44: a relatively small compression reaction force p4 of the second gasket 44 is mainly applied to the rear end of the housing 11. On the other hand, the relatively small compression reaction force p4 of the second gasket 44 and a relatively large compression reaction force p3 of the first gasket 43 are applied to the region between the first intake air passage 13 and the second intake air passage 14, where the shaft hole 21 is formed (the compression reaction three p4+the compression reaction three p3).

Further, the compression reaction force p3 of the first gasket 43 is mainly applied to the front end of the housing 11.

As a result, deformation of the housing 11, which may occur by environmental changes, is suppressed, and displacement between the shaft hole 21 of the shaft penetrating unit 20 and the valve shaft 25 is suppressed. Thus, it is possible to maintain the concentricity between the shaft hole 21 and the valve shaft 25, thereby effectively avoiding contact between the inner peripheral surface of the shaft hole 21 and the valve shaft 25 without increasing the diameter of the shaft hole 21.

The cross section shape of the second gasket 44 is not limited to the hexagonal shape. For example, the second gasket 44 may have a polygonal cross section shape having an axial base end surface and an axial distal end surface, which protrude as if to form a plurality of ridge lines, as well as the inner peripheral surface 44*a* and the outer peripheral surface 44*b*.

Further, the compression reaction force can be set by making the hardness different between the first gasket and the second gasket. An example of this case where the hardness is different between the gaskets will be described with reference to FIG. 6.

Figure 6:
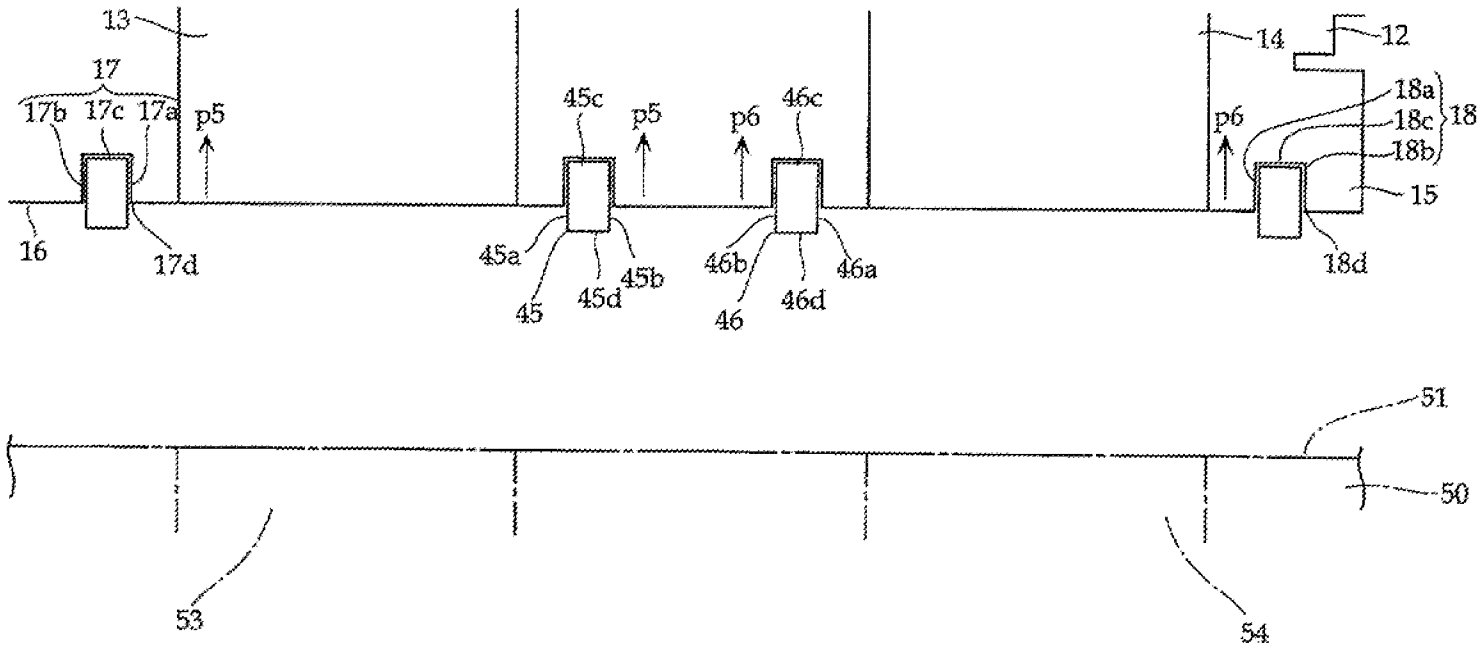
FIG. 6 is a cross-sectional view of principal parts illustrating another example of a gasket.
Figure 7:
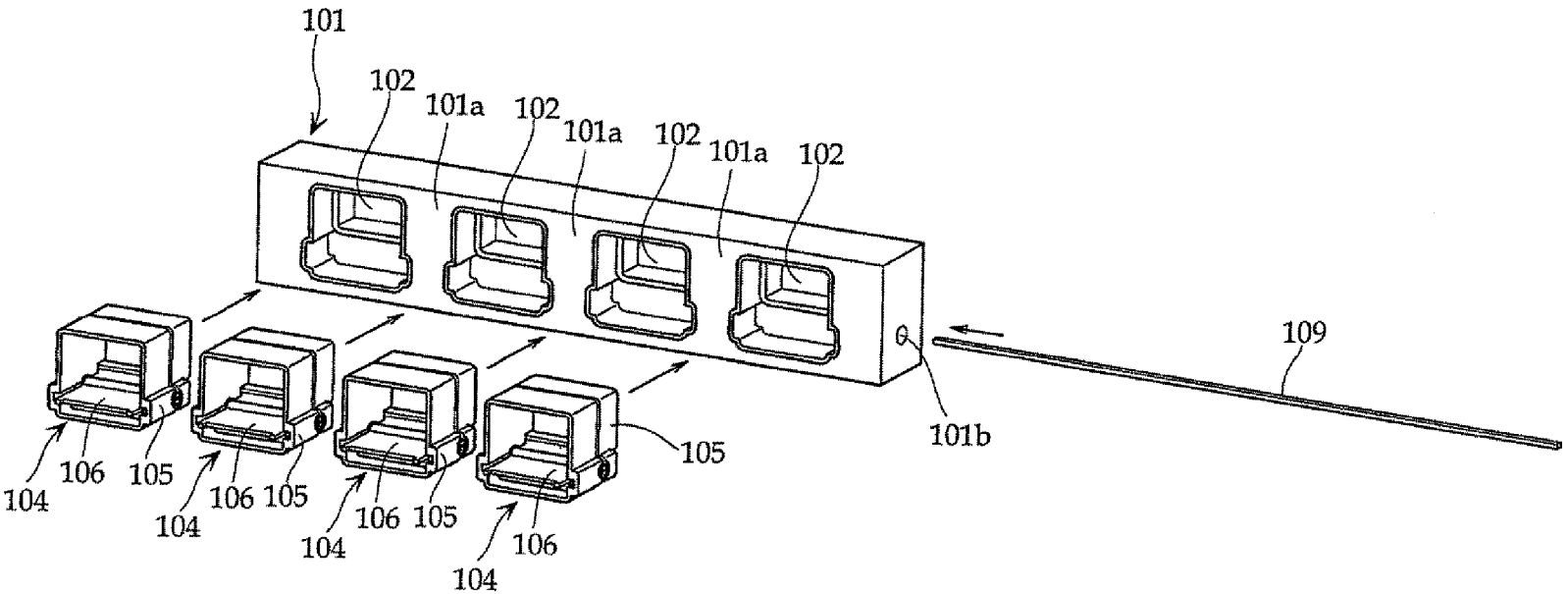
FIG. 7 is a cross-sectional view illustrating an overview of a conventional intake air flow control valve device.
Figure 8:
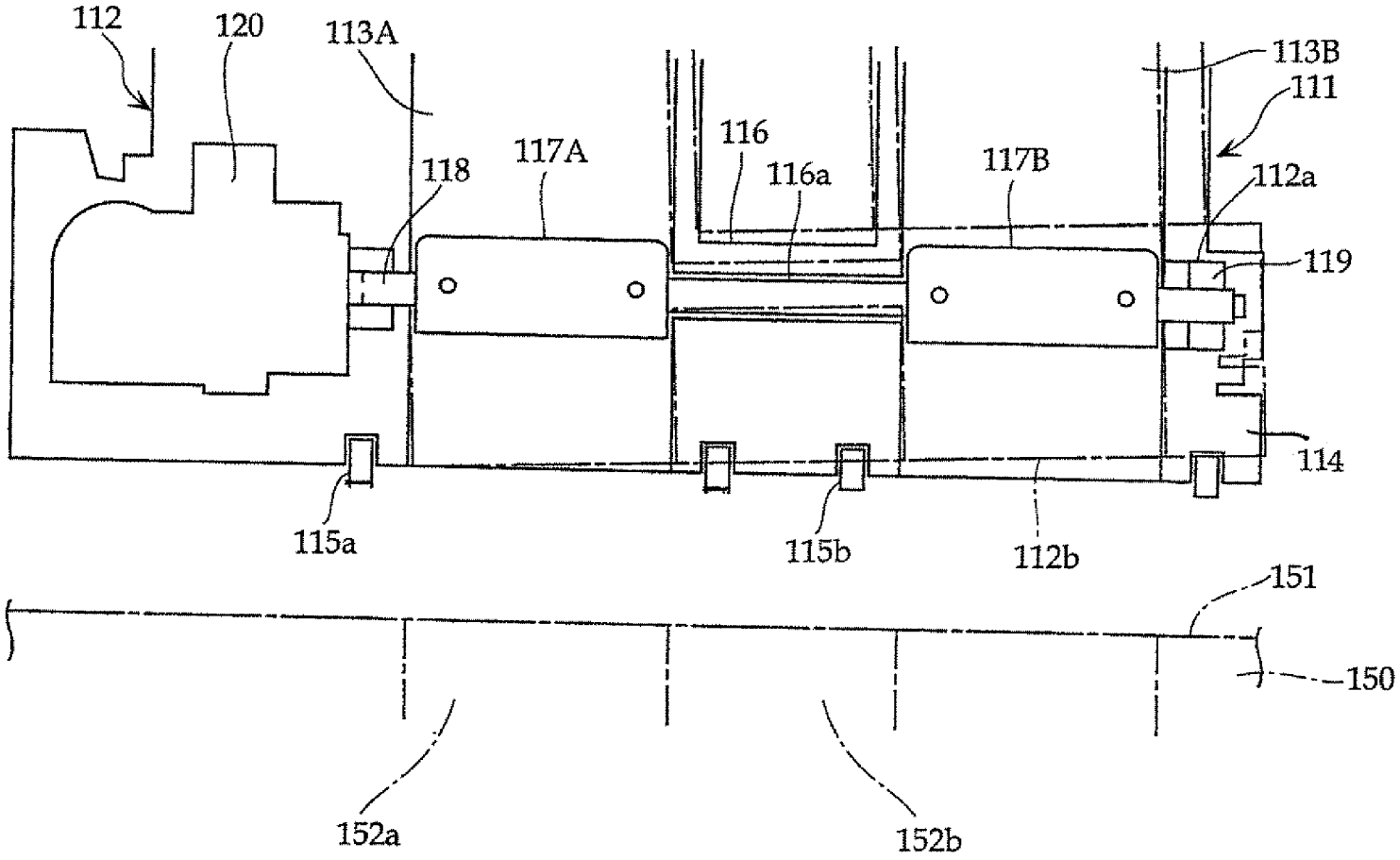
FIG. 8 is a cross-sectional view illustrating an overview of a conventional intake air flow control valve device.

FIG. 6 is a cross-sectional view corresponding to FIG. 4. The first gasket mounting groove 17 and the second gasket mounting groove 18, which are formed on the mount surface 16 of the flange 15, have the same shapes as the first gasket mounting groove 17 and second gasket mounting groove 18, which are illustrated in FIG. 4 described above. Thus, the same reference numerals are allocated to the corresponding parts and description thereof is omitted.

A first gasket 45, which is attached to the first gasket mounting groove 17, is a molded body made of rubber, for example. Further, the first gasket 45 is formed into an annular shape with a rectangular cross section having: an inner surface 45*a*; an outer surface 45*b*, which are opposed to the inner surface 17*a* and the outer surface 17*b* of the first gasket mounting groove 17; a base end surface 45*c*; and a distal end surface 45*d*. As illustrated in FIG. 6, the first gasket 45 is formed such that a certain region including the distal end surface 45*d* protrudes from the opening 17*d* of the first gasket mounting groove 17, when fitted into the first gasket mounting groove 17 such that the base end surface 45*c* abuts on the bottom surface 17*c* of the first gasket mounting groove 17.

A second gasket 46, which is attached to the second gasket mounting groove 18, has the same cross section shape as that of the first gasket 45. Further, the second gasket 46 is formed into an annular shape with a rectangular cross section, having an inner surface 46*a* and an outer surface 46*b*, which are opposed to the inner surface 18*a* and the outer surface 18*b* of the second gasket mounting groove 18, and a base end surface 46*c* and a distal end surface 46*d*.

The material filling rate of the second gasket 46 is lower than that of the first gasket 45. Thus, the hardness of the second gasket 46 is set to be lower than that of the first gasket 45. Since the hardness of the second gasket 46 is thus set so as to be lower than that of the first gasket 45, the compression reaction force of the first gasket 45 is set to be larger than the compression reaction force of the second gasket 46.

The intake air flow control valve device 10 is fastened to the cylinder head 50 by the mounting bolt in a state in which the first gasket 45 and the second gasket 46 are attached to the first gasket mounting groove 17 and the second gasket mounting groove 18, respectively. By the fastening, the first gasket 45 is compressed between the bottom surface 17*c* of the first gasket mounting groove 17 and the cylinder head 50, and the second gasket 46 is compressed between the bottom surface 18*e* of the second gasket mounting groove 18 and the cylinder head 50.

FIG. 6 illustrates the compression reaction threes of the first gasket 45 and the second gasket 46: a relatively small compression reaction force p6 of the second gasket 46 is mainly applied to the rear end of the housing 11. On the other hand, the relatively small compression reaction force p6 of the second gasket 46 and a relatively large compression reaction force p5 of the first gasket 45 are applied to the region between the first intake air passage 13 and the second intake air passage 14, where the shaft hole 21 is formed. Further, the compression reaction force p5 of the first gasket 45 is mainly applied to the front end of the housing 11.

As a result, deformation of the housing 11, which may occur by environmental changes, is suppressed, and displacement between the shaft hole 21 of the shaft penetrating unit 20 and the valve shaft 25 is suppressed. Thus, it is possible to maintain the concentricity between the shaft hole 21 and the valve shall 25, thereby effectively avoiding contact between the inner peripheral surface of the shaft hole 21 and the valve shaft 25 without increasing the diameter of the shaft hole 21.

The present invention is not limited to the above-described implementations, and the present invention can be variously modified without departing from the gist of the present invention. For example, the first gasket and the second gasket may be in other shapes, such as a hollow shape, in accordance with required compression reaction force.

The invention claimed is:

1. An intake air flow control valve device for coupling to a mount surface of a cylinder head to control an intake air flow formed in a combustion chamber comprising:

a resin housing including a tubular housing main body having a first intake air passage and a second intake air passage for receiving an intake air flow from an intake manifold, and a shaft hole communicating the first intake air passage with the second intake air passage, and a flange integrally formed at the end of the housing main body, the flange having a mount surface, the first intake air passage and the second intake air passage opening to the mount surface of the flange;

a valve shaft rotatably penetrating the shaft hole, the first intake air passage, and the second intake air passage, and having a distal end rotatably held at one end side of the housing main body and a base end coupled with an actuator disposed at the other end side of the housing main body; and a first intake air flow control valve and a second intake air flow control valve provided on the valve shaft and disposed in the first intake air passage and in the second intake air passage, respectively, wherein the flange is bolted to the cylinder head, via an annular first gasket along an opening outer periphery of the first intake air passage opened to the mount surface of the flange and via an annular second gasket along an opening outer periphery of the second intake air passage opened to the mount surface of the flange, the first and second gaskets positioned between the flange and the mount surface of the cylinder head for suppressing deformation of the housing, and the second gasket along he opening outer periphery of the second intake air passage has a compression reaction force smaller than a compression reaction force of the first gasket along the opening outer periphery of the first intake air passage.

2. The intake air flow control valve device according to claim 1, wherein the first gasket and the second gasket are in a continuous annular shape with a rectangular cross section, and, when in a no-load state, an axial height of the first gasket is higher than an axial height of the second gasket.

3. The intake air flow control valve device according to claim 1, wherein the first gasket is a continuous annular shape with a rectangular cross section, having an inner peripheral surface and an outer peripheral surface, and the second gasket is a continuous annular shape with a polygonal cross section, having an axial base end surface and an axial distal end surface that protrude so as to form ridge lines, and an inner peripheral surface and an outer peripheral surface.

4. The intake air flow control valve device according to claim 1, wherein the first gasket has the same shape as the second gasket, and the hardness of the first gasket is higher than the hardness of the second gasket.

5. An intake air flow control valve device for coupling to a mount surface of a cylinder head to control an intake air flow formed in a combustion chamber, comprising:

a housing including a tubular housing main body having a first intake air passage and a second intake air passage for receiving an intake air flow from an intake manifold, and a shaft hole communicating the first intake air passage with the second intake air passage, and a flange integrally formed at the end of the housing main body, the flange having a mount surface, the first intake air passage and the second intake air passage opening to the mount surface of the flange;

a valve shaft rotatably penetrating the shaft hole, the first intake air passage, and the second intake air passage, and having a distal end rotatably held at one end side of the housing main body and a base end coupled with an actuator disposed at the other end side of the housing main body; and a first intake air flow control valve and a second intake air flow control valve provided on the valve shaft and disposed in the first intake air passage and in the second intake air passage, respectively, wherein the flange is configured for bolting to the cylinder head, via an annular first gasket along an opening outer periphery of the first intake air passage opened to the mount surface of the flange and via an annular second gasket along an opening outer periphery of the second intake air passage opened to the mount surface of the flange, such that, when bolted to the cylinder head, the first and second gaskets will be positioned between the flange and the mount surface of the cylinder head for suppressing deformation of the housing, and the second gasket along the opening outer periphery of the second intake air passage has a compression reaction force smaller than a compression reaction force of the first gasket along the opening outer periphery of the first intake air passage.

6. The intake air flow control valve device according to claim 5, wherein the first gasket and the second gasket are in a continuous annular shape with a rectangular cross section, and, when in a no-load state, an axial height of the first gasket is higher than an axial height of the second gasket.

7. The intake air flow control valve device according to claim 5, wherein the first gasket is a continuous annular shape with a rectangular cross section, having an inner peripheral surface and an outer peripheral surface, and the second gasket is a continuous annular shape with a polygonal cross section, having an axial base end surface and an axial distal end surface that protrude so as to form ridge lines, and an inner peripheral surface and an outer peripheral surface.

8. The intake air flow control valve device according to claim 5, wherein the first gasket has the same shape as the second gasket, and the hardness of the first gasket is higher than the hardness of the second gasket.

9. The intake air flow control valve device according to claim 5, wherein the housing comprises resin.

10. A mounting kit for an intake air flow control valve device for coupling the intake air flow control valve device to a mount surface of a cylinder head, comprising:

an annular first gasket configured for positioning along an opening outer periphery of a first intake air passage that opens to a mount surface of a flange of the intake air flow control valve device, and in which first intake air passage there is housed a first intake air flow control valve, and an annular second gasket configured for positioning along an opening outer periphery of a second intake air passage that opens to the mount surface of the flange of the intake air flow control valve device, and in which second intake air passage there is housed a second intake air flow control valve, wherein the first and second gaskets are configured such that, when positioned along the respective openings of the first and second intake air passages and compressed by a coupling force of the intake air flow control valve device being mounted to the mount surface of the cylinder head, the second gasket will have a compression reaction force smaller than a compression reaction force of the first gasket.

11. The mounting kit according to claim 10, wherein the first gasket and the second gasket are in a continuous annular shape with a rectangular cross section, and, when in a no-load state, an axial height of the first gasket is higher than an axial height of the second gasket.

12. The mounting kit according to claim 10, wherein the first gasket is a continuous annular shape with a rectangular cross section, having an inner peripheral surface and an outer peripheral surface, and the second gasket is a continuous annular shape with a polygonal cross section, having an axial base end surface and an axial distal end surface that protrude so as to form ridge lines, and an inner peripheral surface and an outer peripheral surface.

13. The mounting kit according to claim 10, wherein the first gasket has the same shape as the second gasket, and the hardness of the first gasket is higher than the hardness of the second gasket.

14. The mounting kit according to claim 10, further comprising an intake air flow control valve device.

15. The mounting kit according to claim 14, wherein the intake air flow control valve device comprises a housing including a tubular housing main body having a first intake air passage and a second intake air passage for receiving an intake air flow from an intake manifold, and a shaft hole communicating the first intake air passage with the second intake air passage, and a flange integrally formed at the end of the housing main body, the flange having a mount surface, the first intake air passage and the second intake air passage opening to the mount surface of the flange.

16. The mounting kit according to claim 15, wherein the intake air flow control valve device further comprises a valve shaft rotatably penetrating the shaft hole, the first intake air passage, and the second intake air passage, and having a distal end rotatably held at one end side of the housing main body and a base end coupled with an actuator disposed at the other end side of the housing main body.

17. The mounting kit according to claim 15, wherein the housing comprises resin.

* * * * *